US007494164B1

(12) United States Patent
Garries et al.

(10) Patent No.: US 7,494,164 B1
(45) Date of Patent: Feb. 24, 2009

(54) WINDOW LATCH

(75) Inventors: Ray Garries, Fox Island, WA (US); Nick Strahm, Klamath Falls, OR (US); Gary Brunold, Klamath Falls, OR (US); James Ripley, Canton, SD (US); Steve Piltingsrud, Sioux Falls, SD (US); Scott Meunier, Sioux Falls, SD (US)

(73) Assignee: JELD-WEN, inc., Klamath Falls, OR (US)

( * ) Notice: Subject to any disclaimer, the term of this patent is extended or adjusted under 35 U.S.C. 154(b) by 0 days.

(21) Appl. No.: 11/982,129

(22) Filed: Nov. 1, 2007

Related U.S. Application Data

(60) Provisional application No. 60/971,142, filed on Sep. 10, 2007.

(51) Int. Cl.
*E05B 63/20* (2006.01)
*E05F 1/00* (2006.01)

(52) U.S. Cl. ..... 292/332; 292/336; 292/338; 292/DIG. 47; 49/449

(58) Field of Classification Search ..... 292/332, 292/338, 336, DIG. 47; 49/449
See application file for complete search history.

(56) References Cited

U.S. PATENT DOCUMENTS

| | | | | |
|---|---|---|---|---|
| 126,872 | A | 5/1872 | Buckman | |
| 417,868 | A | 12/1889 | Janes | |
| 534,185 | A | 2/1895 | Winchester | |
| 769,767 | A | 9/1904 | Phelps | |
| 804,994 | A | 11/1905 | Andrews | |
| 897,719 | A | 9/1908 | Daubaignan | |
| 1,003,386 | A | 9/1911 | Welker | |
| 1,279,353 | A | 9/1918 | Kelly et al. | |
| 1,485,382 | A | 2/1924 | Foley | |
| 1,656,818 | A * | 1/1928 | Dillon | 292/238 |
| 4,824,154 | A | 4/1989 | Simpson | |
| 4,923,230 | A | 5/1990 | Simpson | |
| 5,248,174 | A | 9/1993 | Matz et al. | |
| 5,536,052 | A | 7/1996 | Maier | |
| 5,575,116 | A | 11/1996 | Carlson et al. | |
| 6,364,375 | B1 | 4/2002 | Szapucki et al. | |
| 6,572,158 | B2 | 6/2003 | Szapucki et al. | |
| 2003/0167694 | A1 | 9/2003 | Liang | |
| 2005/0011131 | A1 | 1/2005 | Liang et al. | |
| 2007/0222234 | A1 * | 9/2007 | Liang et al. | 292/338 |

* cited by examiner

*Primary Examiner*—Carlos Lugo
(74) *Attorney, Agent, or Firm*—Nelson Mullins Riley & Scarborough, LLP

(57) ABSTRACT

A latch for use in a window, the latch including a faceplate, a pair of opposed sidewalls, each sidewall defining a pawl mounting recess, a bottom wall extending between the sidewalls, an aperture defined by the faceplate that opens into a first cavity defined by the housing, and a pair of mounting arms disposed within the first cavity. Each mounting arm has a distal end extending both toward the face plate and inwardly toward a longitudinal center plane of the housing. A pawl is pivotably received in the first recess, the pawl including a top surface, an engagement surface, and a pair of mounting pins pivotally received in the pawl mounting recesses. The distal ends of the mounting arms engage the pawl adjacent a respective mounting pin such that the mounting pins are pivotably secured in the pawl mounting recesses.

15 Claims, 8 Drawing Sheets

WINDOW LATCH

CLAIM OF PRIORITY

This application claims priority to U.S. Provisional Patent Application No. 60/971,142, filed on Sep. 10, 2007, entitled "Window Latch," the entire disclosure of which is incorporated by reference herein

FIELD OF THE INVENTION

The present invention relates generally to window latches. More particularly, the present invention relates to a window latch that may be used to limit the degree to which one sash of a window may be moved with regard to a second sash, while also providing a recess by which the associated sash may be grasped thereby and moved relative to the second sash.

BACKGROUND OF THE INVENTION

Double-hung windows are commonly used in residential and other structures. Double-hung window assemblies typically include a window frame and a pair of window sashes. The bottom sash may be positioned inwardly of the top sash so that the sashes overlap and can be slid vertically relative to one another along the guide rails of the window frame. Window sashes can be made of wood, extruded plastic frame members or metal frame members joined at the corners, for example, to form a generally rectangular frame in which the glazing is installed.

Double-hung windows often include a locking mechanism located at the point where the sashes meet when the window assembly is in a closed position. A latch mechanism may be fixed on the header of the bottom sash and the corresponding latch-receiving mechanism is fixed on the sill of the top sash. When the window sashes are in the closed position, the lock may be secured to prevent any movement of the sashes.

Many double-hung windows also include latches (including, for example, vent latches) that are typically mounted on the inside surface of the top sash. The latches generally are manually activated to extend from a flush position to an extended position in which the latches project outwardly over the top rail of the bottom sash. When in the flush position, the sashes may be slid relative to each other over the full range of the window frame. In the extended position, the latches allow the sashes to be slid relative to each other to limit the amount of travel of the sashes, and thus provide a ventilation opening at the top or bottom of the window frame. As well, hand grip recesses are often provided at or near the upper member of the top sash to facilitate its movement. Because the hand grips and latches on existing windows are separate components, individual mounting apertures must be provided for each component in the window sash.

SUMMARY OF THE INVENTION

The present invention recognizes and addresses considerations of prior art constructions and methods. In one embodiment of the present invention, a latch for use in a window having a top sash and a bottom sash slidably mounted in a window frame includes a housing having a faceplate, a pair of opposed sidewalls, each sidewall defining a pawl mounting recess, a bottom wall extending between the sidewalls, an aperture defined by the faceplate that opens into a first cavity defined by the housing, and a pair of mounting arms disposed within the first cavity. Each mounting arm has a proximal end adjacent the bottom wall and a distal end extending both toward the face plate and inwardly toward a longitudinal center plane of the housing, the mounting arms being disposed on opposing sides of the first cavity. A pawl is pivotably received in the first recess, the pawl including a top surface, an engagement surface, and a pair of mounting pins disposed on opposing sides of the pawl. Each mounting pin is pivotally received in one of the pawl mounting recesses. The distal ends of the mounting arms engage the pawl adjacent a respective mounting pin such that the mounting pins are pivotably secured in the pawl mounting recesses as the pawl is pivoted between a first position in which the top surface is coplanar with the faceplate and a second position in which the pawl extends beyond the faceplate such that the engagement surface is transverse to the faceplate.

Another embodiment of the latch for use in a window having a top sash and a bottom sash slidably mounted in a window frame includes a housing including a faceplate, a pair of opposed sidewalls, each sidewall defining a pawl mounting recess, a bottom wall extending between the sidewalls, an aperture defined by the faceplate that opens into a first cavity defined by the housing, and a first retention arm disposed within the first cavity. The first retention arm has a proximal end adjacent the bottom wall and a distal end extending both toward the face plate and inwardly toward a longitudinal center plane of the housing. A pawl is pivotably received in the first recess, the pawl including a top surface, a bottom surface, an engagement surface, a first retention recess formed on a side of the pawl, and a pair of mounting pins disposed on opposing sides of the pawl, each mounting pin being pivotally received in one of the pawl mounting recesses. The pawl is selectively pivotable between a first position in which the top surface is coplanar with the faceplate and a second position in which the pawl extends beyond the faceplate such that the engagement surface is transverse to the faceplate. The distal end of the first retention arm is configured to engage the first retention recess to maintain the pawl in the first position and to engage the bottom surface of the pawl to maintain the pawl in the second position.

Yet another embodiment of the latch for use in a window having a top sash and a bottom sash slidably mounted in a window frame includes a housing including a faceplate, a pair of opposed sidewalls, a bottom wall extending between the sidewalls, a pair of opposed end walls, a center wall disposed between the end walls such that a first cavity is defined between the center wall and a first of the end walls and a second cavity is disposed between the center wall and a second of the end walls, and an aperture defined by the faceplate that opens into the first and second cavities. A pawl is pivotably received in the first recess, the pawl including a top surface and an engagement surface. The pawl is pivotable between a first position in which the top surface is coplanar with the faceplate and a second position in which the pawl extends beyond the faceplate such that the engagement surface is transverse to the faceplate. The second cavity is configured such that a user can grasp the window vent latch by the second cavity and move the respective sash within the window frame.

Yet another embodiment of the present invention is a method of making a latch for use in a window having a top sash and a bottom sash slidably mounted in a window frame. The method includes providing a housing having a faceplate, a pair of opposed sidewalls, each sidewall defining a pawl mounting recess, a bottom wall extending between the sidewalls, an aperture defined by the faceplate that opens into a first cavity defined by the housing, and a pair of mounting arms disposed within the first cavity. Each mounting arm includes a proximal end adjacent the bottom wall and a distal end extending both toward the face plate and inwardly toward a longitudinal center plane of the housing, the mounting arms being disposed on opposing sides of the first cavity. A pawl is provided that is pivotably received in the first recess, the pawl including a top surface, an engagement surface, and a pair of mounting pins disposed on opposing sides of the pawl, each mounting pin being pivotally received in one of the pawl mounting recesses, the distal ends of the mounting arms engaging the pawl adjacent a respective mounting pin such that the mounting pins are pivotably secured in the pawl mounting recesses. The pawl is configured to pivot between a first position in which the top surface is coplanar with the faceplate and a second position in which the pawl extends beyond the faceplate such that the engagement surface is transverse to the faceplate.

Yet another embodiment of the latch for use in a window having a top sash and a bottom sash slidably mounted in a window frame includes a housing having a faceplate, a pair of opposed sidewalls, a bottom wall extending between the sidewalls, and an aperture defined by the faceplate that opens into a first cavity defined by the housing. A pawl is pivotably received in the first recess, the pawl having a top surface, a bottom surface, an engagement surface, and a first retention recess formed on a side of the pawl. The pawl is selectively pivotable between a first position in which the top surface is coplanar with the faceplate and a second position in which the pawl extends beyond the faceplate such that the engagement surface is transverse to the faceplate. Means for pivotably mounting the pawl to the housing and means for selectively retaining the pawl in one of the first position and the second position are included.

The accompanying drawings, which are incorporated in and constitute a part of this specification, illustrate one or more embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended drawings, in which.

Figure 1:
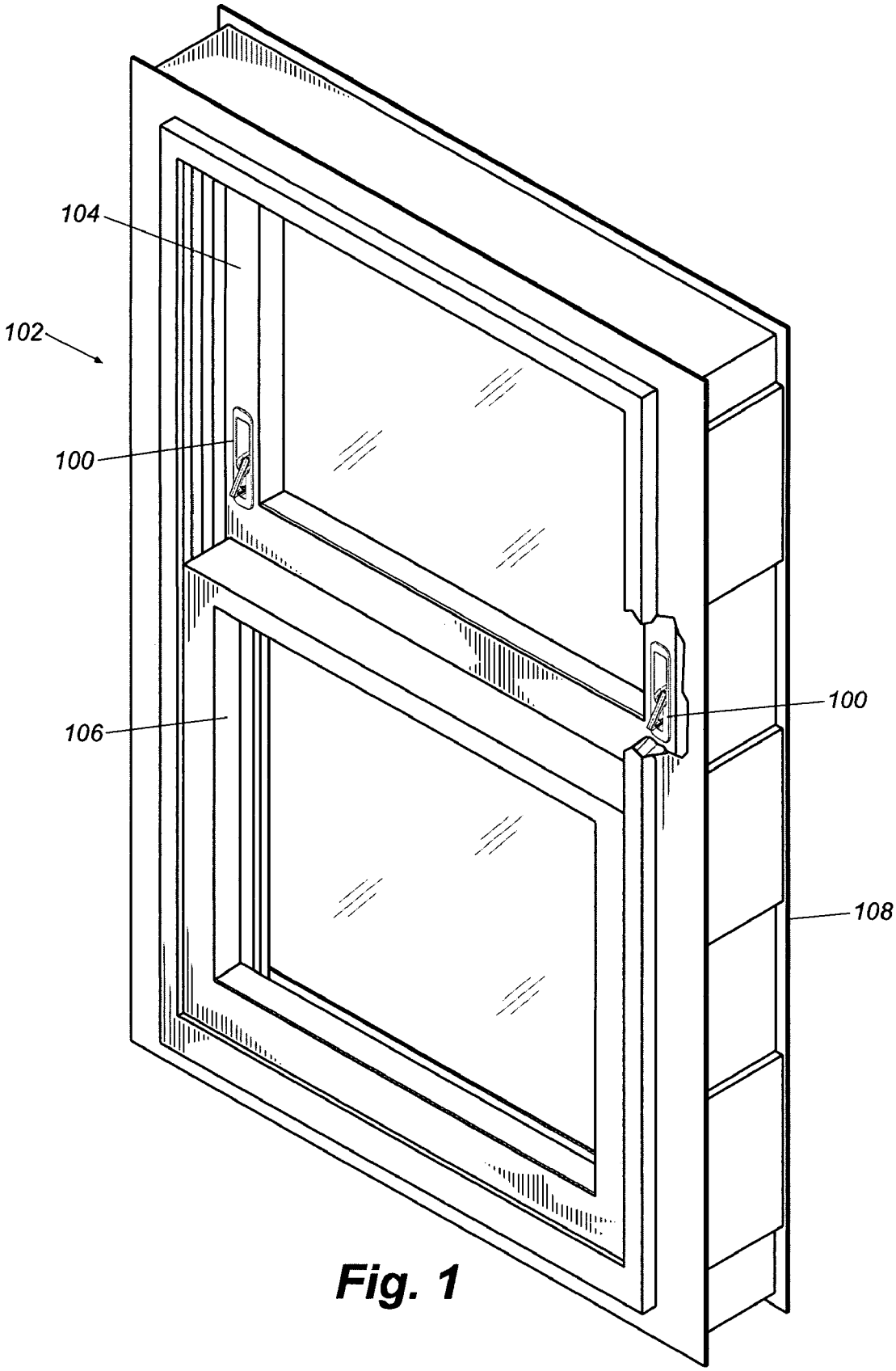
FIG. 1 is a perspective view of a window with an embodiment of a latch according to the present invention, installed in the top sash of the window.

Repeat use of reference characters in the present specification and drawings is intended to represent same or analogous features or elements of the invention according to the disclosure.

DETAILED DESCRIPTION OF THE PREFERRED EMBODIMENTS

Reference will now be made in detail to presently preferred embodiments of the invention, one or more examples of which are illustrated in the accompanying drawings. Each example is provided by way of explanation, not limitation, of the invention. In fact, it will be apparent to those skilled in the art that modifications and variations can be made in the present invention without departing from the scope and spirit thereof. For instance, features illustrated or described as part of one embodiment may be used on another embodiment to yield a still further embodiment. Thus, it is intended that the present invention covers such modifications and variations as come within the scope of the appended claims and their equivalents.

Referring now to FIG. 1, a pair of window latches 100 in accordance with the present invention is shown mounted on an inner surface of a top sash 104 of a window assembly 102. As shown, window latches 100 are mounted a desired distance, typically 4 to 6 inches above an upper member of a bottom sash 106 of the window assembly. As such, as discussed in greater detail below, window latches 100 can be used to limit the sliding motion of top sash 104 and bottom sash 106 to the desired range of motion within window frame 108. In the preferred embodiment shown, either top sash 104, bottom sash 106, or both sashes, may be slidably moved within window frame 108, such that a ventilation space is created at the top, bottom, or top and bottom, of window assembly 102, respectively.

Figure 2:
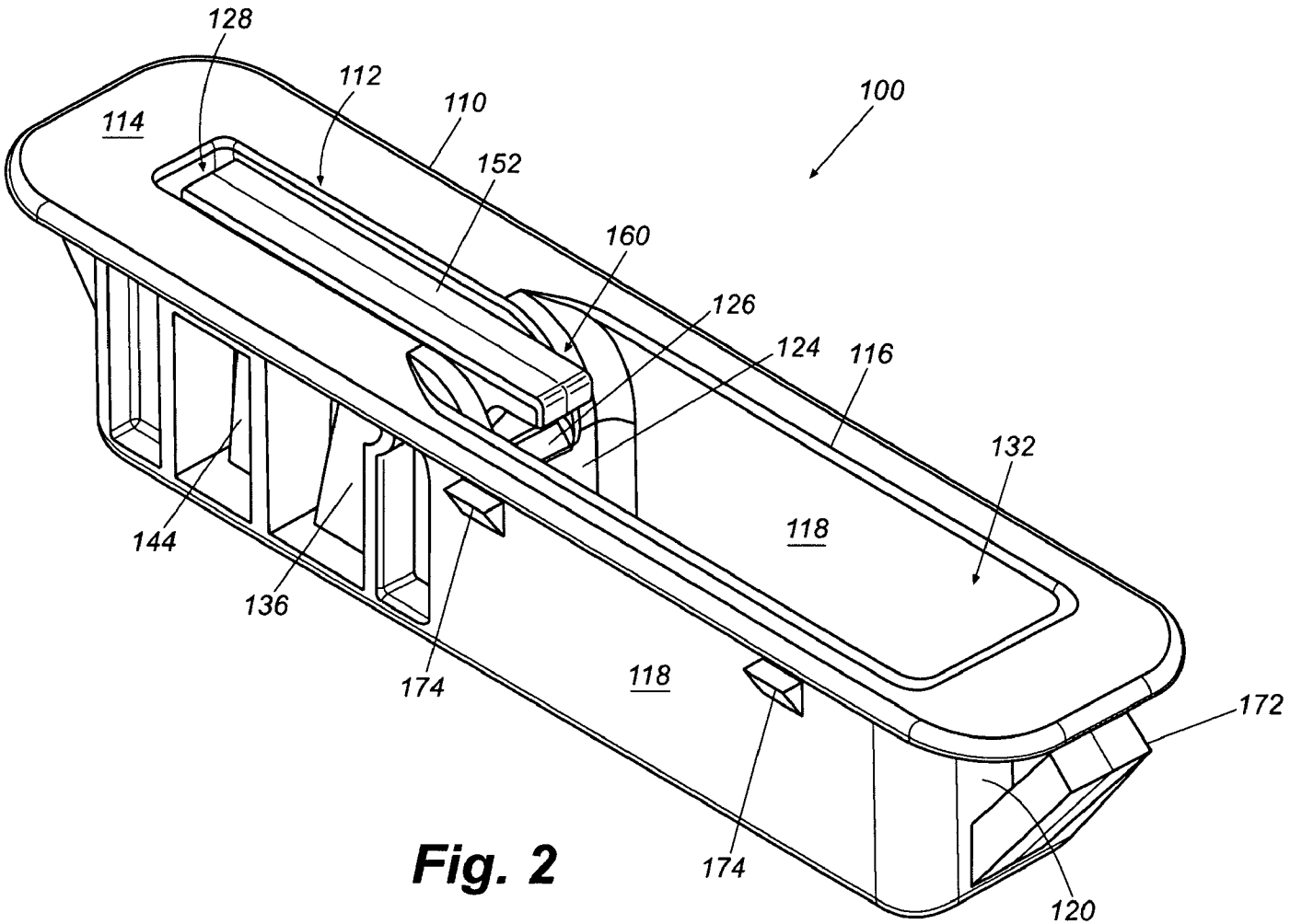
FIG. 2 is a perspective view of the window latch as shown in FIG. 1 with the pawl in the closed position.
Figure 3:
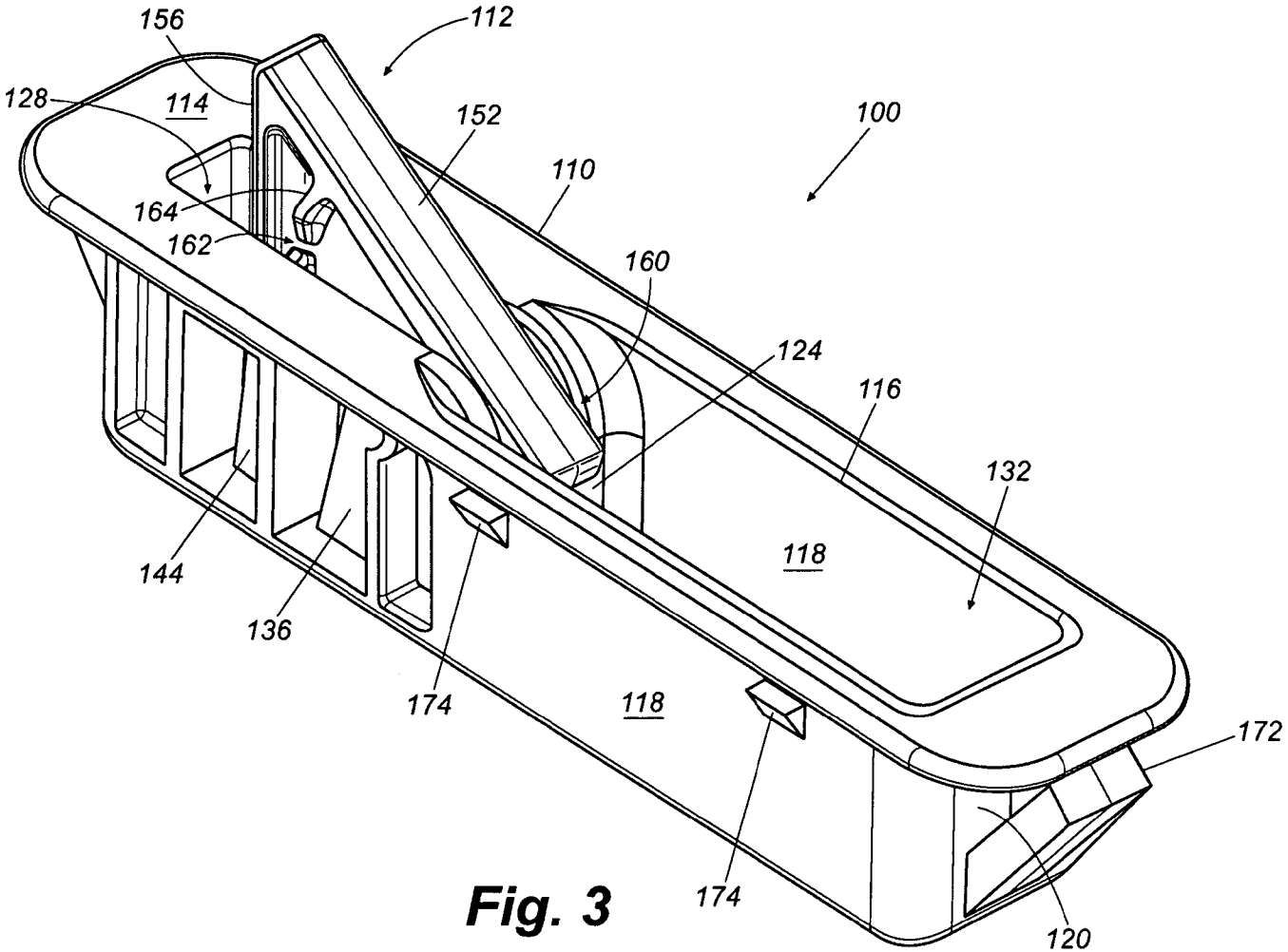
FIG. 3 is a perspective view of the window latch as shown in FIG. 1 with the pawl in the open position.

Referring to FIGS. 2 and 3, a preferred embodiment of window latch 100 includes a housing 110 and a pawl 112 pivotally mounted therein. FIG. 2 shows window latch 100 with pawl 112 in a first position in which pawl 112 is retracted into a first cavity 128 defined by housing 110. So positioned, pawl 112 is flush with a faceplate 114 of housing 110 such that pawl 112 does not interfere with the relative sliding motion of top sash 104 and bottom sash 106 relative to each other within window frame 108. As shown in FIG. 3, pawl 112 is in a second position in which pawl 112 extends outwardly beyond faceplate 114 of housing 110. As such, pawl 112 is positioned such that relative sliding motion between top sash 104 and bottom sash 106 is prevented when an upper portion of bottom sash 106 is engaged by pawl 112, as discussed in greater detail below.

Figure 4:
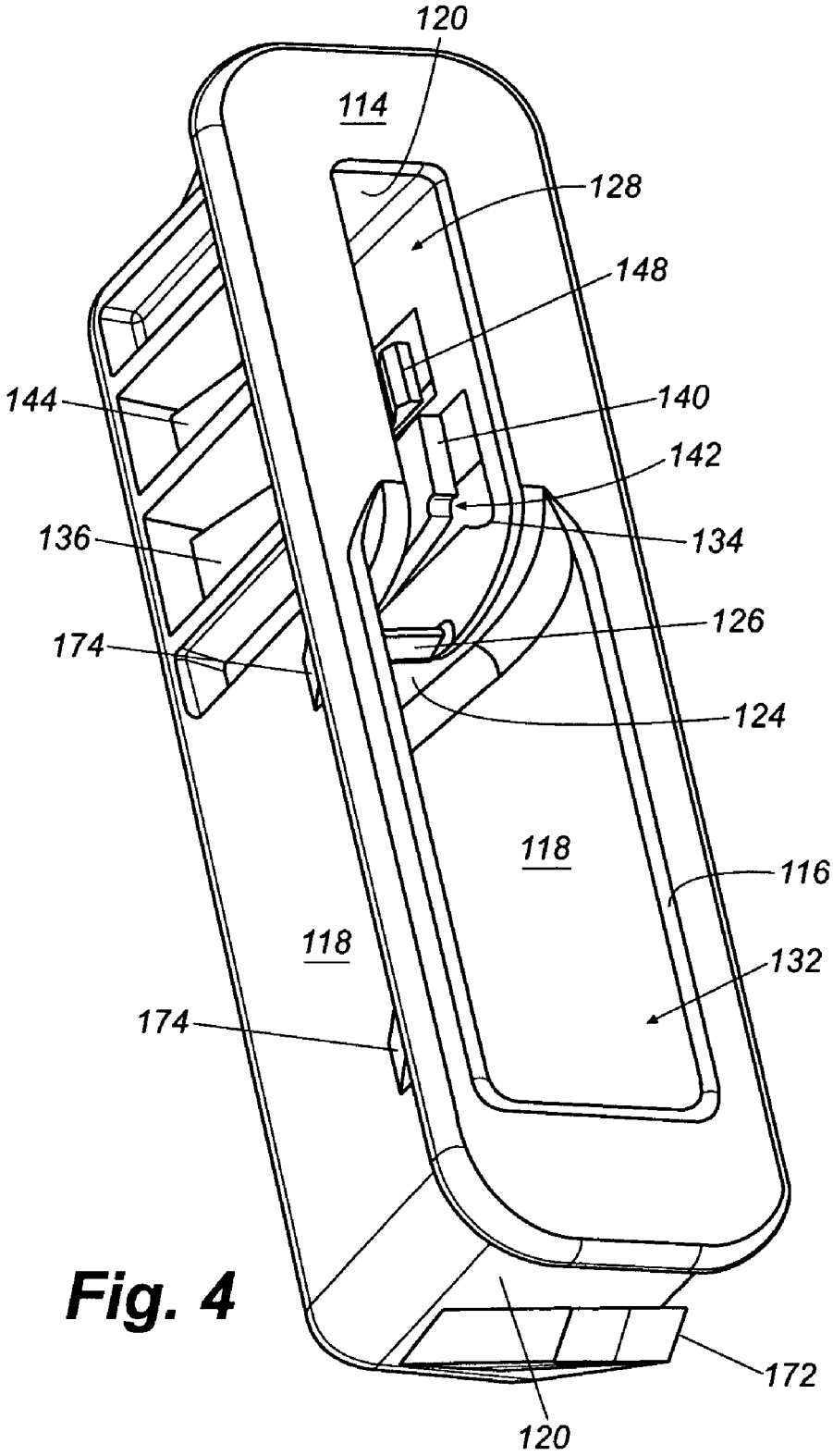
FIG. 4 is a perspective view of the housing of the window latch as shown in FIG. 1.
Figure 5:
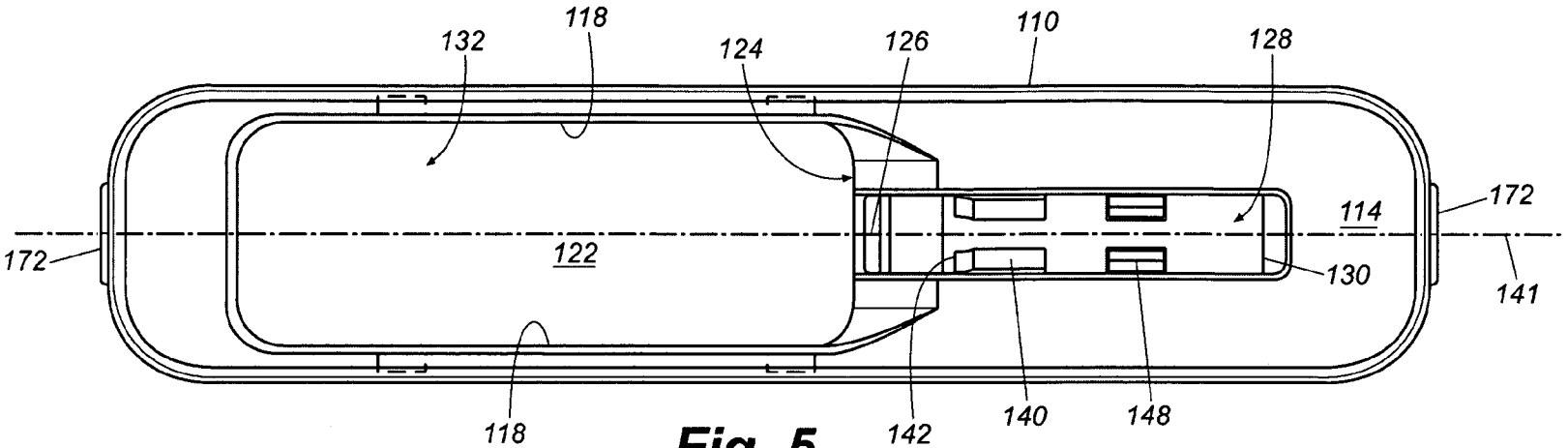
FIG. 5 is a top view of the housing of the window latch as shown in FIG. 1.
Figure 6:
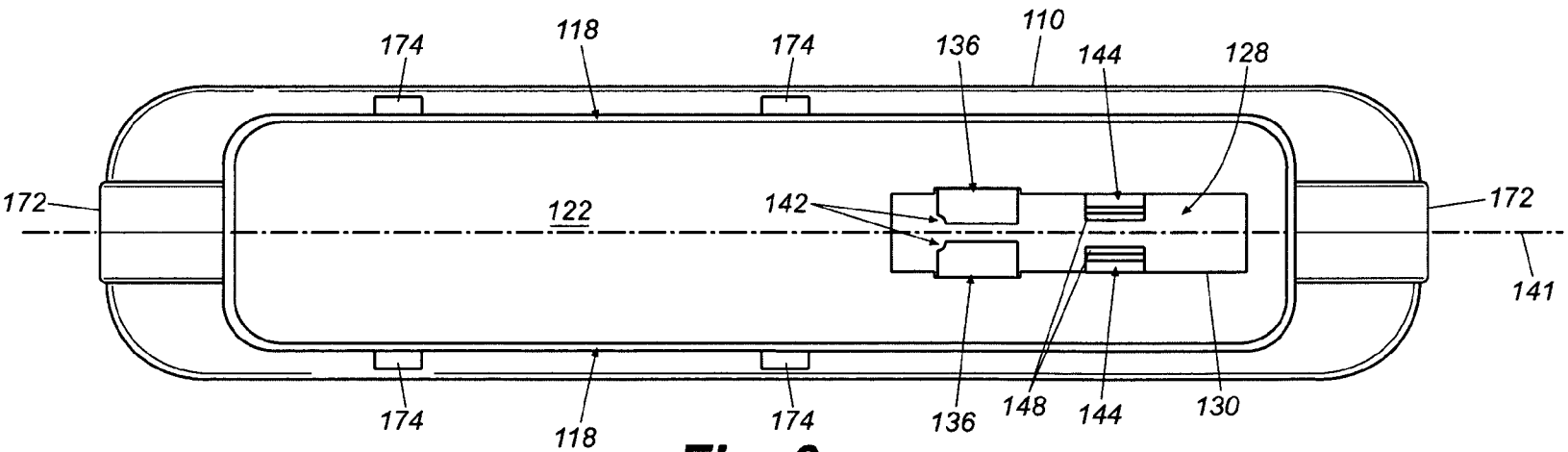
FIG. 6 is a bottom view of the housing of the window latch as shown in FIG. 1.

Referring additionally to FIGS. 4 through 6, faceplate 114 of housing 110 defines an aperture 116 that opens into first cavity 128 and a second cavity 132. Housing 110 also includes a pair of opposed side walls 118, a pair of opposed end walls 120, and a bottom wall 122. Bottom wall 122 is parallel to faceplate 114 and both side walls 118 and end walls 120 extend between, and are substantially perpendicular to, both faceplate 114 and bottom wall 122. A center wall 124 extends upwardly from bottom wall 122 between opposed end walls 120 such that first cavity 128 is defined between center wall 124 and a first of end walls 120 and second cavity 132 is defined between center wall 124 and a second of end walls 120. Center wall 124 terminates at a stop surface 126 positioned adjacent faceplate 114.

As best seen in FIG. 6, first cavity 128 includes an aperture 130 defined by bottom wall 122 that opens into first cavity 128. Aperture 130 facilitates assembling window latch 100, as discussed in greater detail below. As shown, a pair of opposed, mounting arms 136 extends upwardly from bottom wall 122 toward faceplate 114 of housing 110. Each mounting arm 136 includes a proximal end adjacent bottom wall 122 and a distal end 140 that depends upwardly toward faceplate 114. As well, each mounting arm depends inwardly toward a longitudinal center plane 141 of housing 110 such that distal end 140 of each mounting arm 136 is closer to center plane 141 than is the respective proximal end of each mounting arm 136. A pin recess 142 is formed on the distal end of each mounting arm 136 such that when mounting arms 136 are deflected outwardly away from center plane 141, pin recesses 142 are positioned adjacent correspondingly shaped pawl mounting recesses 134 (FIG. 9) defined in each side wall 118. Pawl mounting recesses 134 and pin recesses 142 are configured to receive a pair of mounting pins 158 (FIG. 9) extending outwardly from pawl 112, as discussed in greater detail below.

A pair of opposed retention arms 144 extend upwardly from bottom wall 122 toward faceplate 114 of housing 110. Each retention arm 144 includes a proximal end adjacent bottom wall 122 and a distal end 148 depending upwardly toward faceplate 114. As well, each distal end 148 depends inwardly toward center plane 141 such that the distal end of each retention arm 144 is closer to center plane 141 than is the respective proximal end of each retention arm 144. Further, the distal end of each retention arm 144 forms a catch for selectively engaging pawl 112, as discussed below.

Figure 10:
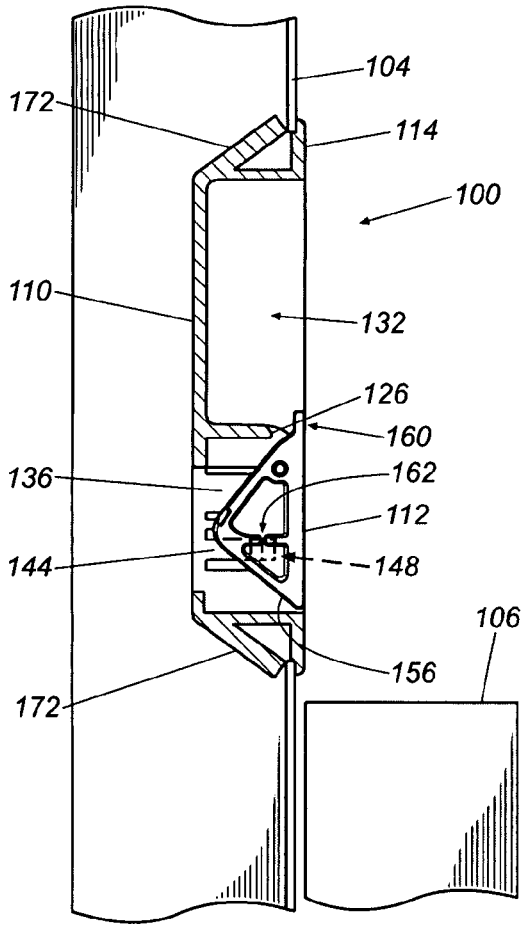
FIG. 10 is a partial cross-sectional view of the window latch shown installed in a window assembly, with the pawl in the closed position.
Figure 11:
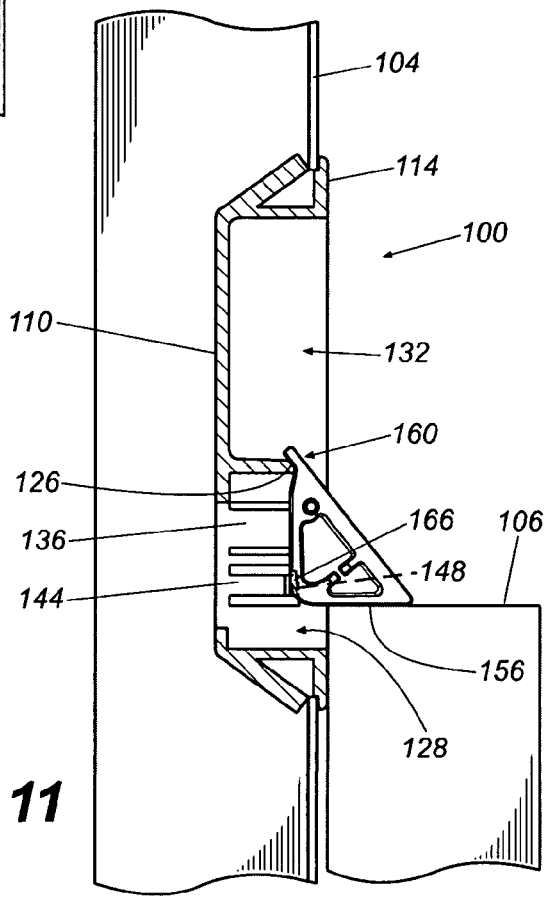
FIG. 11 is a partial cross-sectional view of the latch shown installed in a window assembly, with the pawl in the open position.

Housing 110 preferably includes a pair of arms extending both outwardly from an outer surface of the housing and upwardly toward faceplate 114. The distal ends of arms 172 are spaced from faceplate 114 such that a portion of a window sash is receivable therebetween, such that window latch 100 can be mounted to a correspondingly shaped aperture formed in a window sash (FIGS. 10 and 11). Additionally, pairs of tabs 174 extend outwardly from the outer surface of housing 110. Tabs 174 are also spaced from faceplate 114 such that the portion of the window sash in which window latch 100 is mounted is received therebetween.

Figure 7:
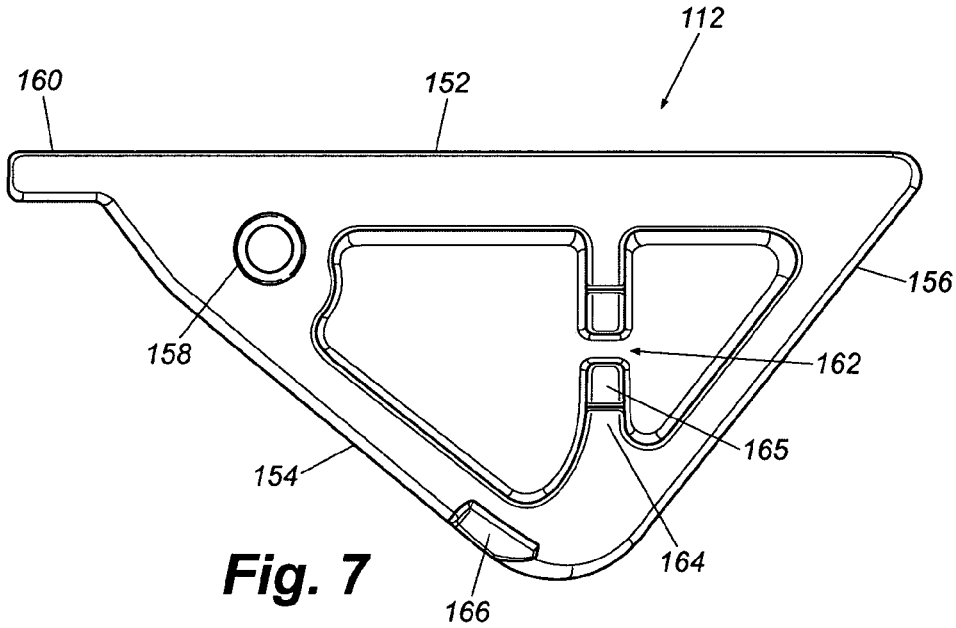
FIG. 7 is a side view of the pawl of the window latch as shown in FIG. 1.
Figure 8:
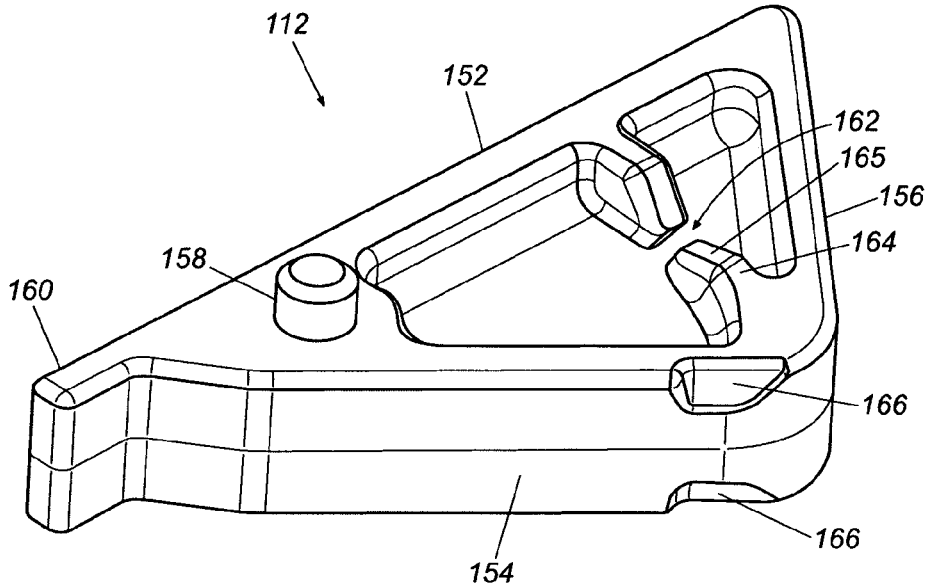
FIG. 8 is a perspective view of the pawl of the window latch as shown in FIG. 1.

Referring to FIGS. 7 and 8, pawl 112 includes a top surface 152, a bottom surface 154, and an engagement surface 156. A pair of mounting pins 158 depend outwardly from opposing sides of pawl 112 and are configured for pivotally mounting pawl 112 in first cavity 128 of housing 110. An actuation tab 160 depends outwardly from top surface 152 and is configured to allow a user to pivotally move pawl 112 from the first position in which pawl 112 is received within first cavity 128 to the second position in which pawl 160 extends outwardly beyond faceplate 114 of housing 110, as discussed below. Each side of pawl 112 also includes a track 164 for slidably engaging a catch 148 of an associated retention arm 144 and a retention recess 162 that is selectively engagable by the associated catch 148. A camming surface 165 between catch 162 and track 164 facilitates moving pawl 112 between the first and second positions. A pair of notches 166 is formed on opposite sides of bottom surface 154 of pawl 112. Each notch 166 is also selectively engagable by a catch 150 of an associated retention arm 144.

Figure 9:
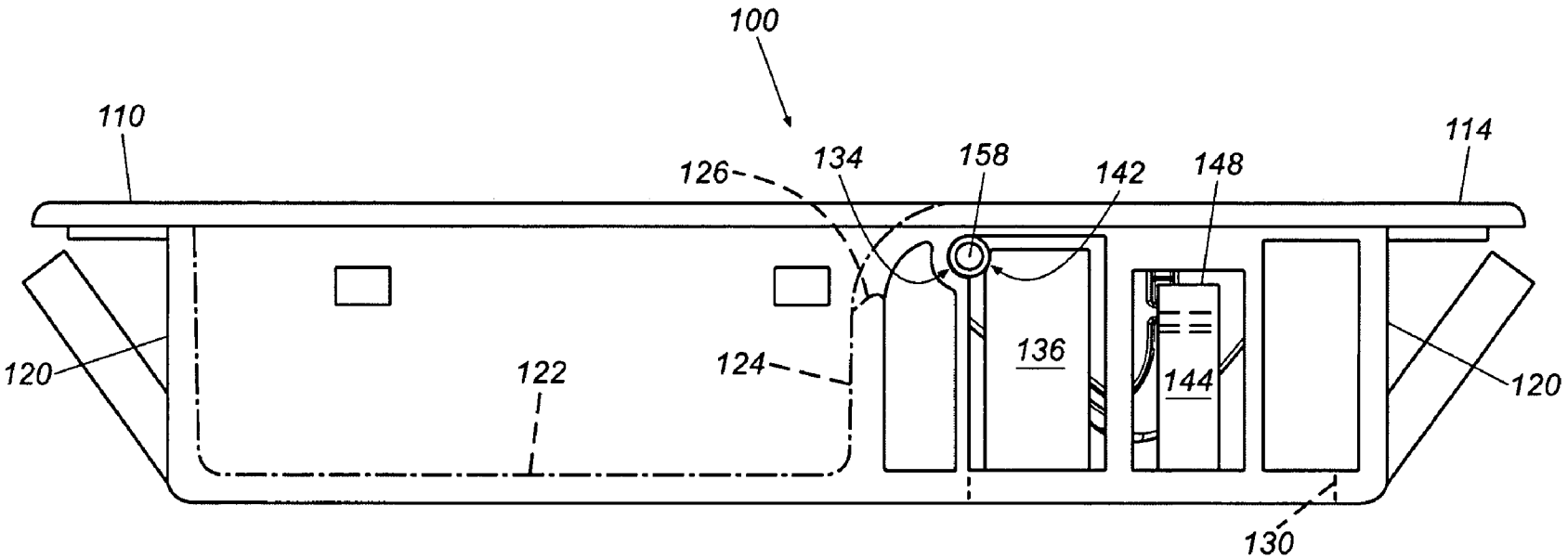
FIG. 9 is a side view of the window latch as shown in FIG. 1.

To assemble pawl 112 and housing 110 of the preferred embodiment shown in FIG. 9, pawl 112 is passed upwardly into first cavity 128 through aperture 130 formed in the bottom wall of housing 110. As the end of pawl 112 including actuation tab 160 and mounting pins 138 is urged upwardly into first cavity 128, mounting arms 136 are urged outwardly away from center plane 141 by mounting pins 158. Pawl 112 is slid into first cavity until mounting pins 158 are received in pawl mounting recesses 134. With mounting pins 158 so positioned and no longer exerting outward force, mounting arms 136 depend inwardly such that pin recesses 142 engage the associated mounting pins 158, thereby retaining them in pawl mounting recesses 134. Next, top surface 152 of pawl 112 is pivoted upwardly toward faceplate 114, thereby causing retention arms 144 to be cammed outwardly away from center plane 141. When catches 148 on the distal ends of retention arms 144 engage retention recesses 162, pawl 112 is secured in the first position in which top surface 152 is substantially flush with faceplate 114 of housing 110, as shown in FIG. 9.

As shown in FIG. 10, pawl 112 is in the first position in which pawl 112 is received within first cavity 128 such that top surface 152 of pawl 112 is substantially flush with faceplate 114 of housing 110. With pawl 112 in the first position, both top sash 104 and bottom sash 106 can be slid freely within window frame 108 since pawl 112 is fully retracted into first cavity 128 of housing 110. In the first position, catches 148 on distal ends 148 of retention arms 144 engage respective retention recesses 162 on pawl 112 such that pawl 112 is securely retained within first cavity 128. Second cavities 132 of each window latch 100 are configured to allow a user to grasp top sash 104 by the second cavities, thereby facilitating movement of the top sash.

To place pawl 112 in the second position in which pawl 112 extends outwardly beyond faceplate 114 of housing 110, a user pushes inwardly on actuation tab 160. Upon exertion of adequate force, cam surfaces 165 cause catches 148 on the distal ends of retention arms 144 to be urged outwardly, thereby allowing pawl 112 to pivot about mounting pins 158. As pawl 112 is pivoted, each catch 148 rides along a respective track 164 and eventually engages a respective notch 166 formed on bottom surface 154 of pawl 112. Pivotal motion of pawl 112 is limited by engagement of actuation tab 160 with stop surface 126 on center wall 124. When in the second position, engagement surface 156 of pawl 112 is transverse to faceplate 114 of housing. As such, sliding motion of top sash 104 and bottom sash 106 relative to each other is limited by engagement of engagement surface 156 with the upper portion of bottom sash 106. As well, further pivotal motion of pawl 112 relative to housing 110 is prevented by the abutment of actuation tab 160 with stop surface 126.

To return pawl 112 to the first position shown in FIG. 10, the user slidingly separates top sash 104 from bottom sash 106 such that pawl 112 can be pivoted without engaging bottom sash 106. Next, the user pushes inwardly on top surface 152 of pawl 112 with sufficient force to cause notches 166 to cam the distal ends of retention arms 144 outwardly. As pawl 112 pivots inwardly into first cavity 128, catches 148 of retention arms 144 ride along tracks 164 until each catch 148 engages its respective retention recess 162 on pawl 112. Pawl 112 is now secured in the first position and top sash 104 and bottom sash 106 are once again freely slidable with regard to each other within window frame 108.

While one or more preferred embodiments of the invention are described above, it should be appreciated by those skilled in the art that various modifications and variations can be made in the present invention without departing from the scope and spirit thereof. For example, the window latch may be installed in a frame of a window that only has one slidable sash such that motion of the sash relative to the frame may be limited thereby. As well, the window latch be installed in the sash of a window in which the sashes are slid in a horizontally rather than vertically. It is intended that the present invention cover such modifications and variations as come within the scope and spirit of the appended claims and their equivalents.

What is claimed is:

1. A latch for use in a window comprising a top sash and a bottom sash slidably mounted in a window frame, the latch comprising:

a housing comprising a faceplate, a pair of opposed sidewalls, each sidewall defining a pawl mounting recess, a bottom wall extending between the sidewalls, an aperture defined by the faceplate that opens into a first cavity defined by the housing, a pair of retention arms disposed within the first cavity, each retention arm having a proximal end adjacent the bottom wall and a distal end extending both toward the faceplate and inwardly toward a longitudinal center plane of the housing, and a pair of mounting arms disposed within the first cavity, each mounting arm comprising a proximal end adjacent the bottom wall and a distal end extending both toward the face plate and inwardly toward the longitudinal center plane of the housing, the mounting arms being disposed on opposing sides of the first cavity; and a pawl pivotably received in the first recess, the pawl comprising a top surface, an engagement surface, a pair of retention recesses formed on opposing sides of the pawl, and a pair of mounting pins disposed on opposing sides of the pawl, each mounting pin being pivotally received in one of the pawl mounting recesses, wherein the distal ends of the mounting arms engage the pawl adjacent a respective mounting pin such that the mounting pins are pivotably secured in the pawl mounting recesses as the pawl is pivoted between a first position in which the top surface is coplanar with the faceplate and a second position in which the pawl extends beyond the faceplate such that the engagement surface is transverse to the faceplate, wherein the distal ends of the retention arms engage a respective retention recess when the pawl is in the first position, thereby retaining the pawl in the first position.

2. The latch of claim 1, wherein the pawl further comprises a bottom surface and the distal ends of the first and second retention arms engage the bottom surface of the pawl when the pawl is in the second position such that the pawl is maintained in the second position.

3. The latch of claim 1, wherein the housing further comprises a first end wall and a second end wall, the first and second end walls being disposed on opposing ends of the first cavity.

4. The latch of claim 3, wherein the pawl comprises an actuation tab disposed on the top surface of the pawl, wherein the actuation tab is configured to be moved inwardly into the housing until the actuation tab abuts a top surface of the second end wall, thereby limiting pivotal motion of the pawl relative to the housing.

5. The latch of claim 3, wherein the housing further comprises a third end wall defining a second cavity is defined in the housing between the second and third end walls, the second cavity being configured to be grasped by a user such that the top sash of the window can be slid within the window frame.

6. A latch for use in a window comprising a top sash and a bottom sash slidably mounted in a window frame, the latch comprising:

a housing comprising a faceplate, a pair of opposed sidewalls, each sidewall defining a pawl mounting recess, a bottom wall extending between the sidewalls, an aperture defined by the faceplate that opens into a first cavity defined by the housing, and a first and second retention arm disposed within the first cavity, each retention arm comprising a proximal end adjacent the bottom wall and a distal end extending both toward the face plate and inwardly toward a longitudinal center plane of the housing; and a pawl pivotably received in the first recess, the pawl comprising a top surface, a bottom surface, an engagement surface, a first and second retention recess formed on opposing sides of the pawl, and a pair of mounting pins disposed on opposing sides of the pawl, each mounting pin being pivotally received in one of the pawl mounting recesses, the pawl being selectively pivotable between a first position in which the top surface is coplanar with the faceplate and a second position in which the pawl extends beyond the faceplate such that the engagement surface is transverse to the faceplate, wherein the distal end of each retention arm is configured to engage a respective retention recess to maintain the pawl in the first position and to engage the bottom surface of the pawl to maintain the pawl in the second position.

7. The latch of claim 6, wherein the distal ends of the first and second retention arms engage the bottom surface of the pawl when the pawl is in the second position wherein the pawl is maintained in the second position.

8. The latch of claim 6, wherein the housing further comprises a first end wall and a second end wall, the first and second end walls being disposed at opposing ends of the first cavity.

9. The latch of claim 8, wherein the pawl comprises an actuation tab disposed on the top surface of the pawl, and wherein the actuation tab is configured to be moved inwardly into the housing until the actuation tab abuts a top surface of the second end wall, thereby limiting pivotal motion of the pawl relative to the housing.

10. The latch of claim 8, wherein the housing further comprises a third end wall such that a second cavity is defined between the second and the third end walls, the second cavity being configured to be grasped by a user such that the top sash of the window can be slid within the window frame.

11. The latch of claim 6, further comprising:

a pair of mounting arms disposed within the first cavity, each mounting arm comprising a proximal end adjacent the bottom wall and a distal end extending both toward the face plate and inwardly toward the longitudinal center plane of the housing, the mounting arms being disposed on opposing sides of the first cavity, wherein the distal ends of the mounting arms engage the pawl adjacent a respective mounting pin such that the mounting pins are pivotably secured in the pawl mounting recesses as the pawl is pivoted between the first position in which the top surface is coplanar with the faceplate and the second position in which the pawl extends beyond the faceplate.

12. A latch for use in a window comprising a top sash and a bottom sash slidably mounted in a window frame, the latch being installed in the top sash and comprising:

a housing comprising a faceplate, a pair of opposed sidewalls, a bottom wall extending between the sidewalls, a pair of opposed end walls, a center wall disposed between the end walls defining a first cavity is between the center wall and a first of the end walls and a second cavity disposed between the center wall and a second of the end walls, an aperture defined by the faceplate that opens into the first and second cavities, and a first and a second retention arm disposed within the first cavity, the first and second retention arms comprising a proximal end adjacent the bottom wall and a distal end extending both toward the faceplate and inwardly toward a longitudinal center plane of the house; and a pawl pivotably received in the first recess, the pawl comprising a top surface, an engagement surface, and a first and a second retention recess formed on opposite sides of the pawl, the pawl being pivotable between a first position in which the top surface is coplanar with the faceplate and a second position in which the pawl extends beyond the faceplate such that the engagement surface is transverse to the faceplate, wherein the second cavity is configured such that a user can grasp the latch by the second cavity and move the respective sash within the window frame, wherein the distal ends of the first and second retention arms engage the first and second retention recesses when the pawl is in the first position, thereby retaining the pawl in the first position.

13. The latch of claim 12, further comprising:

a pawl mounting recess defined in each sidewall, and a pair of mounting arms disposed within the first cavity, each mounting arm comprising a proximal end adjacent the bottom wall and a distal end extending both toward the face plate and inwardly toward a longitudinal center plane of the housing, the mounting arms being disposed on opposing sides of the first cavity; and a pair of mounting pins disposed on opposing sides of the pawl, each mounting pin being pivotally received in one of the pawl mounting recesses, wherein the distal ends of the mounting arms engage the pawl adjacent a respective mounting pin such that the mounting pins are pivotably secured in the pawl mounting recesses as the pawl is pivoted between the first position and the second position.

14. The latch of claim 12, wherein the pawl further comprises a bottom surface and the distal ends of the first and second retention arms engage the bottom surface of the pawl when the pawl is in the second position such that the pawl is maintained in the second position.

15. The latch of claim 12, wherein the pawl comprises an actuation tab disposed on the top surface of the pawl, and wherein the actuation tab is configured to be moved inwardly into the housing until the actuation tab abuts a top surface of the center wall, thereby limiting pivotal motion of the pawl relative to the housing.

* * * * *